US007165499B2

(12) United States Patent
Apps et al.

(10) Patent No.: US 7,165,499 B2
(45) Date of Patent: Jan. 23, 2007

(54) REINFORCED PALLET

(75) Inventors: William P. Apps, Alpharetta, GA (US); Sean T. Ogburn, Lawrenceville, GA (US); Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 89 days.

(21) Appl. No.: 10/357,551

(22) Filed: Feb. 4, 2003

(65) Prior Publication Data

US 2004/0149180 A1 Aug. 5, 2004

(51) Int. Cl.
*B65D 19/38* (2006.01)

(52) U.S. Cl. ..... 108/57.25; 108/902

(58) Field of Classification Search ..... 108/57.25, 108/51.11, 901, 902, 56.1, 56.3, 57.26
See application file for complete search history.

(56) References Cited

U.S. PATENT DOCUMENTS

| | | | | |
|---|---|---|---|---|
| 5,117,762 | A * | 6/1992 | Shuert | 108/57.25 |
| 5,402,735 | A * | 4/1995 | DeJean | 108/57.25 |
| 5,413,052 | A * | 5/1995 | Breezer et al. | 108/57.25 |
| 5,791,262 | A * | 8/1998 | Knight et al. | 108/57.25 |
| 5,836,255 | A * | 11/1998 | Uitz | 108/57.25 |
| 5,868,080 | A | 2/1999 | Wyler et al. | |
| 5,894,803 | A * | 4/1999 | Kuga | 108/57.25 |
| 6,109,190 | A * | 8/2000 | Hale et al. | 108/57.25 |
| 6,125,770 | A * | 10/2000 | Brandenburg | 108/57.25 |
| 6,199,488 | B1 * | 3/2001 | Favaron et al. | 108/57.25 |
| 6,622,642 | B1 * | 9/2003 | Ohanesian | 108/57.25 |
| 6,718,888 | B1 * | 4/2004 | Muirhead | 108/57.25 |

FOREIGN PATENT DOCUMENTS

| | | |
|---|---|---|
| GB | 1 481 805 | 8/1977 |
| GB | 1 571 190 | 7/1980 |
| GB | 2 395 185 | 5/2004 |

* cited by examiner

*Primary Examiner*—Jose V. Chen

(57) ABSTRACT

A reinforced pallet includes a pallet body having a plurality of flexible support arms, each integrally molded adjacent one of the plurality of channels formed in the pallet body. Each of the flexible support arms is configured to flex outward away from the channel upon insertion of an elongated reinforcement member into the channel and to subsequently return to its own deformed position in the channel, thereby retaining the reinforcement member in the channel. In this manner, the reinforcement members can be inserted and locked in the pallet body in a single motion.

30 Claims, 8 Drawing Sheets

REINFORCED PALLET

BACKGROUND OF THE INVENTION

The present invention relates generally to pallets and more particularly to a plastic pallet arranged to receive reinforcement members.

Pallets are often used to store and transport goods. Pallets maintain the goods at a distance above the floor such that they can readily be lifted and moved by a forklift. Plastic pallets are lighter and more durable than wooden pallets; however, elongated metal or composite reinforcement members in the plastic pallets have been used for some applications in order to increase the rigidity of the pallet.

One reinforced pallet design, disclosed in U.S. Pat. No. 5,868,080, includes a plurality of composite reinforcing bars. A plurality of channels are formed in the pallet body. Each of the reinforcing bars is secured within one of the channels and retained in the pallet body by several pieces that are snap-fit together. The multiple pieces required to retain the reinforcing bars in the pallet increase the cost and assembly time of this reinforced pallet.

SUMMARY OF THE INVENTION

A pallet according to the present invention includes a plurality of channels formed in a molded plastic pallet body. A flexible support arm is formed adjacent each channel in the deck. Each support arm is selectively movable away from the channel in order to permit the insertion of an elongated reinforcement member. Each support arm is also movable back into the channel to selectively lock the reinforcement member in the channel. Preferably, each support arm is integrally molded with the deck and is flexible, such that it can be deformed out away from the channel by the reinforcement member as the reinforcement member is being inserted. The support arm returns to its undeformed position in the channel to lock the reinforcement member in place after the reinforcement member has been inserted past the support arm.

A minimal number of parts are required for assembly of the pallet of the present invention. Further, the reinforcement member is easily inserted and locked in the pallet in a single motion, thus speeding and simplifying assembly.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
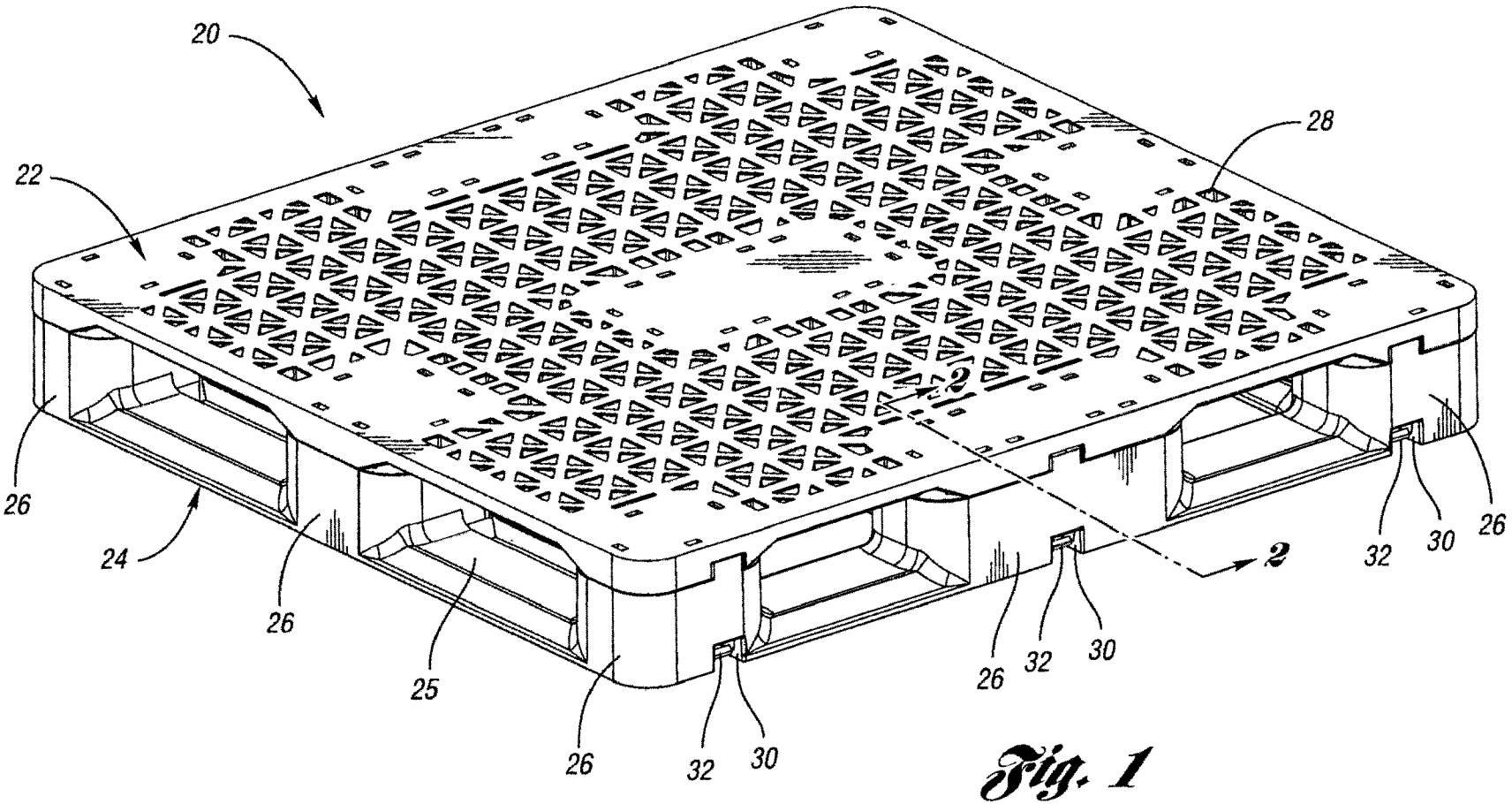
FIG. 1 is a perspective view of the reinforced pallet of the present invention.

A reinforced pallet 20 is shown in FIG. 1. The pallet 20 comprises a molded plastic upper deck 22 and a molded plastic lower deck 24 having supports 26. The upper deck 22 and lower deck 24 are preferably formed of polypropylene via an injection molding process, but of course can be formed of any type of plastic applicable for the desired use. The top surface 28 of the upper deck 22 includes drain holes as are normally molded into plastic pallets. The upper deck 22 is secured to the supports 26 of the lower deck 24 by snap-fit connections, adhesive, connectors, welds, or any other known method. Spaces between the supports 26 permit the insertion of forklift tines under the upper deck 22 to lift the pallet 20. The pallet 20 may include any such details and variations as are commonly known in plastic pallets.

Figure 6:
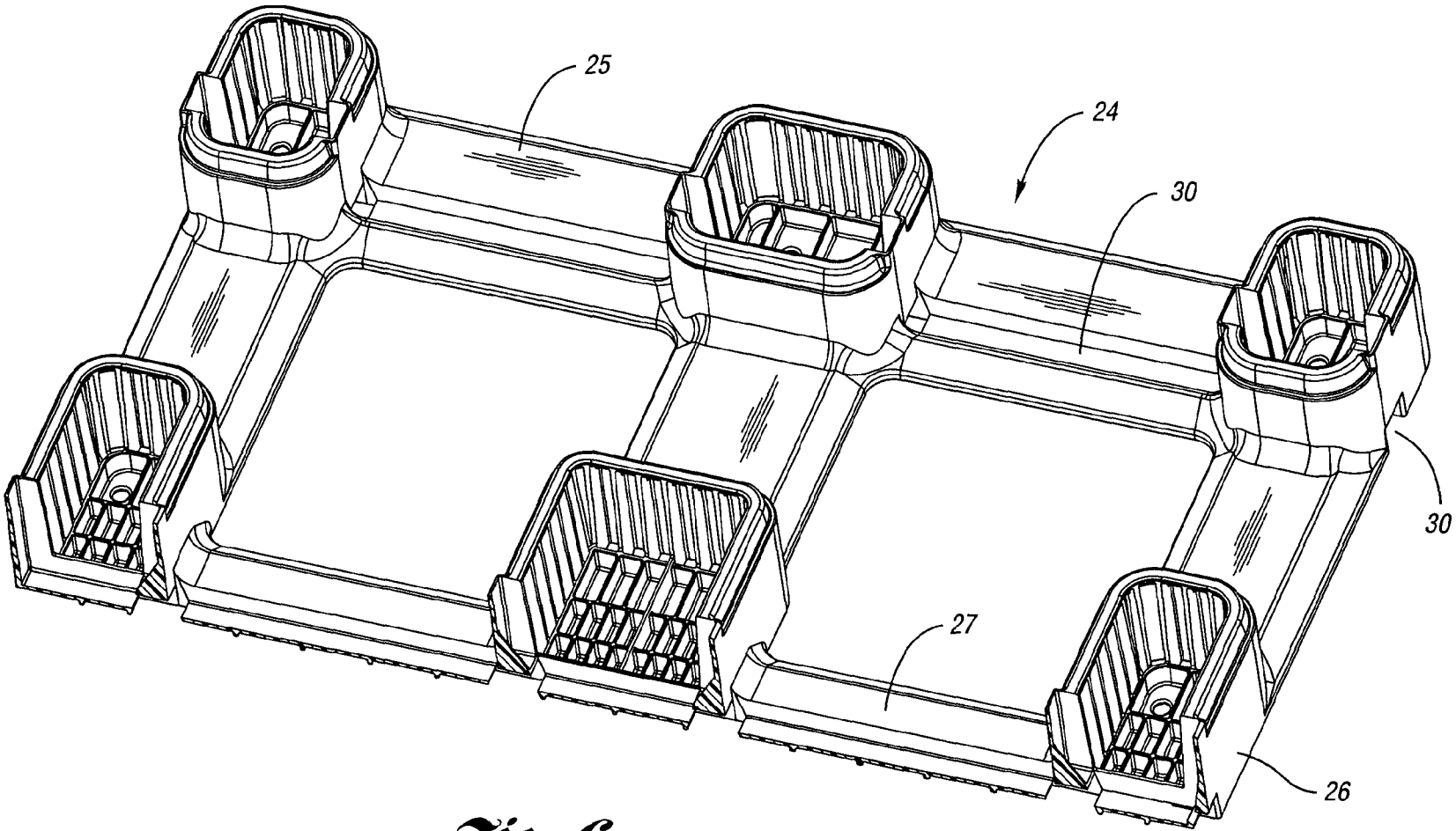
FIG. 6 is a perspective view of a half-section of a lower deck of the present pallet.

In the present invention, the pallet 20 includes at least one, and preferably a plurality of molded channels 30. As shown in FIGS. 1 and 6, three channels 30 are molded into the lower deck 24 (one in each peripheral rail 25, and one down the center cross-member 27), but any number of channels 30 could be molded into either deck 22, 24. Each of the channels 30 shown extends across the entire width of the lower deck 24. A flexible support arm 32 is disposed at one end of each channel 30, while the opposite end (not shown) of each channel 30 is preferably closed, but may include a similar support arm to facilitate assembly from either end.

Figure 2:
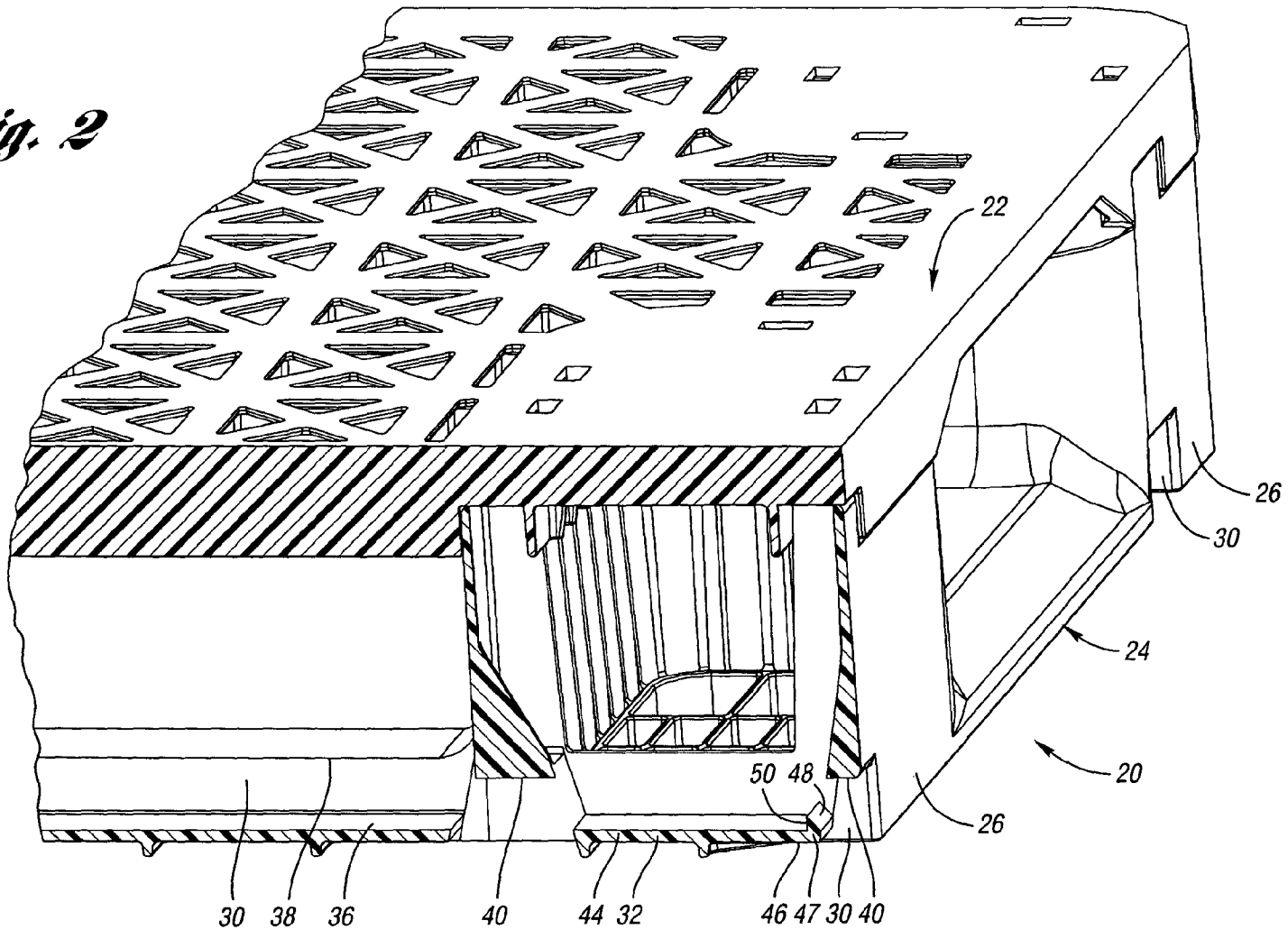
FIG. 2 is an enlarged sectional view taken along the line 2—2 of FIG. 1.

FIG. 2 is a perspective view with the pallet broken away along the line 2—2 of FIG. 1. In FIG. 2, it can be seen that the channel 30 extends rearward between rails 36 and 38, while channel 30 is defined between the flexible support arm 32 and a pair of guides 40 at a forward end. The flexible support arm 32 is integrally molded with the lower deck 24 at a rearward end 44 of the flexible support arm 32 to define a unitary construction. The forward end 46 of the support arm 32 is cantilevered such that the forward end 46 is flexible and can be elastically deformed. The forward end 46 of the support arm 32 forms a latch 47 which includes an inclined surface 48 normally positioned in the channel 30 when the support arm 32 is undeformed so as to block ingress and egress from the channel 30. A retaining surface 50 is formed adjacent the inclined surface 48 and rearward of the inclined surface 48 and is generally perpendicular to the support arm 32 and the channel 30. The support arm 32 is sufficiently flexible such that the inclined surface 48 and retaining surface 50 can be selectively moved out of channel 30 by applying a force to the forward end 46 of the support arm 32 and will return to its undeformed state normally, with the inclined surface 48 and retaining surface 50 projecting into the channel 30.

Figure 3:
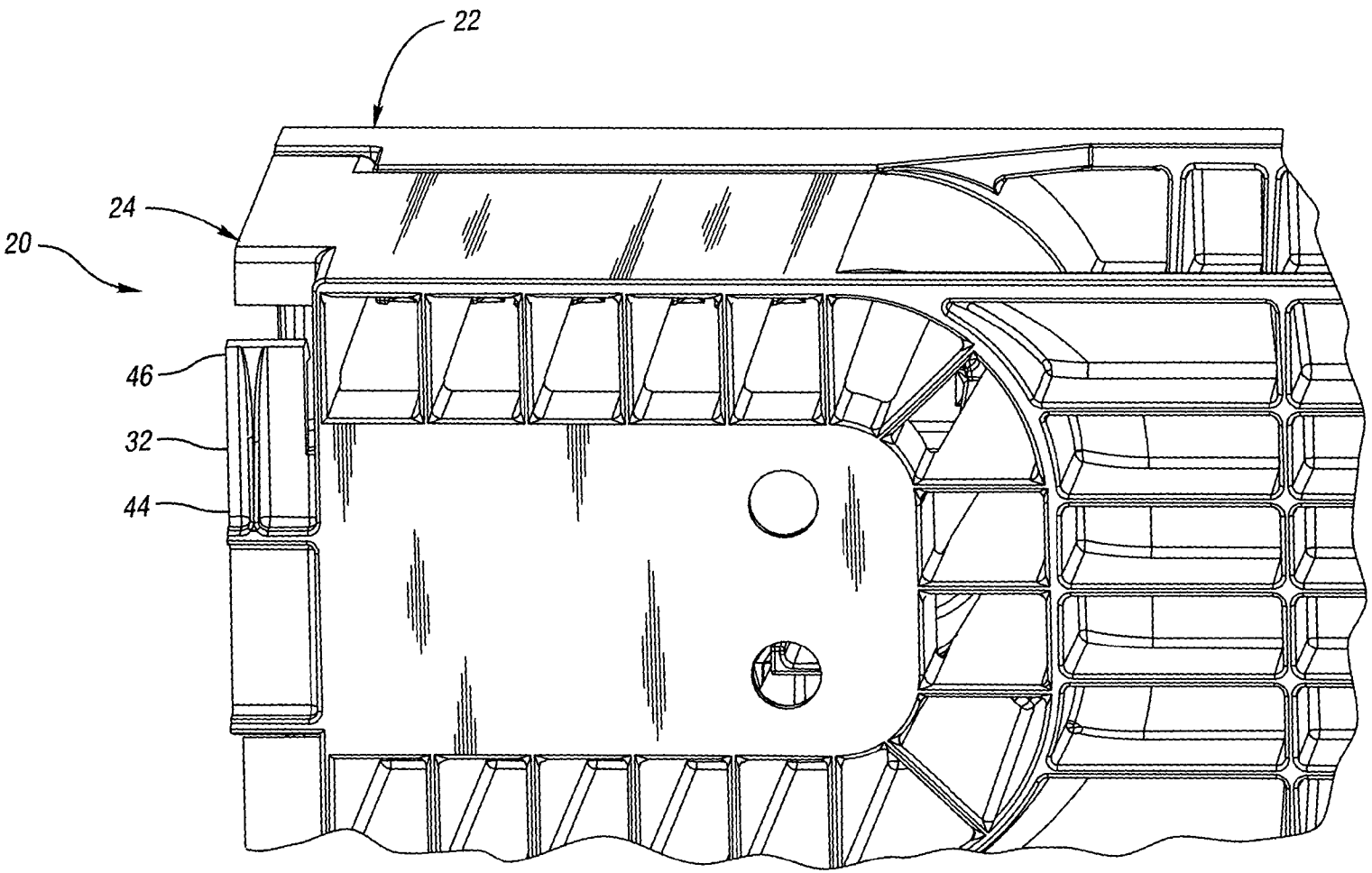
FIG. 3 is a bottom view of the partially broken away pallet of FIG. 2.
Figure 4:
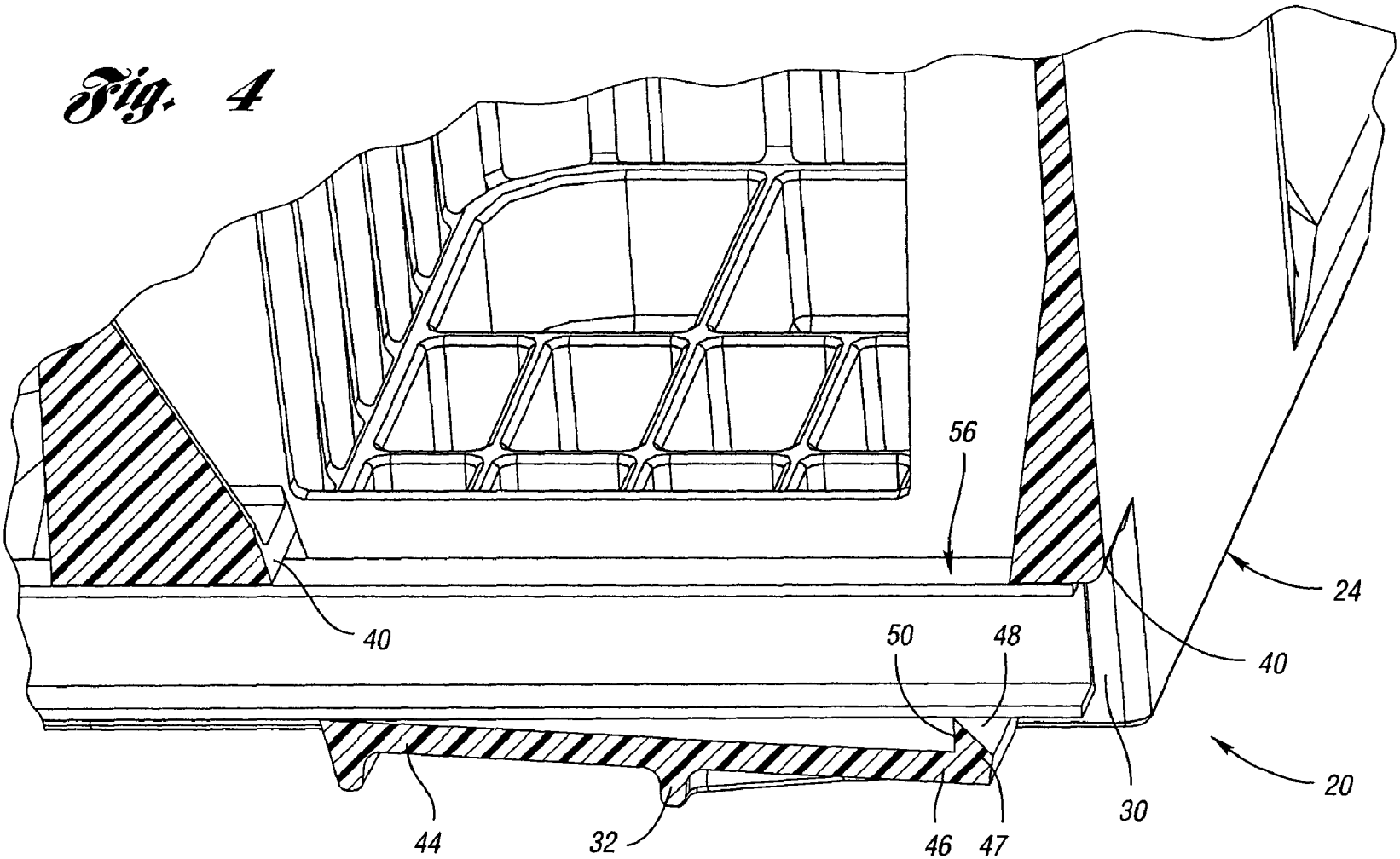
FIGS. 4 and 4*a* illustrate the pallet broken away along line 2—2 with a reinforcement member partially inserted within the channel.
Figure 4A:
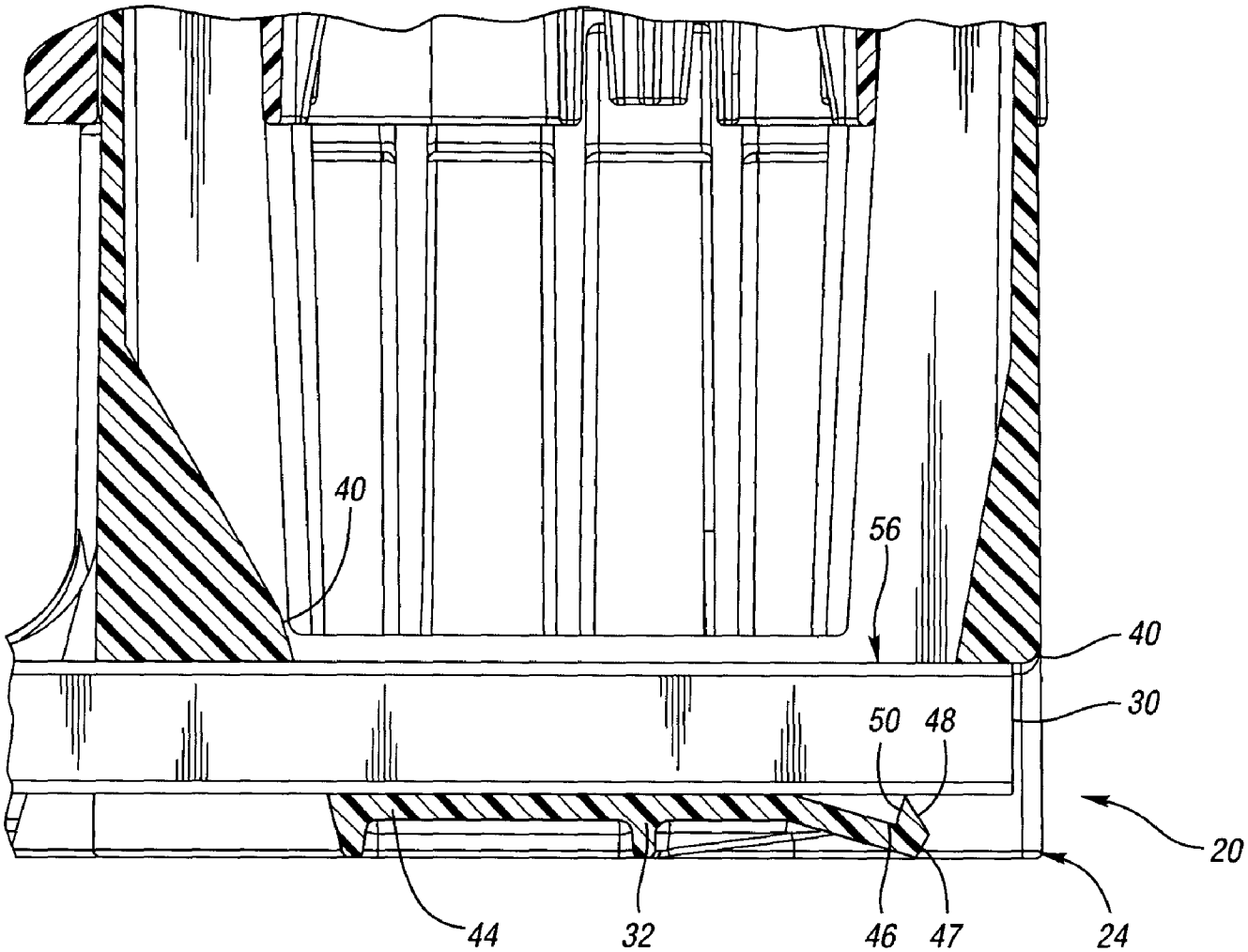

FIG. 3 is a bottom view of the partially broken away pallet 28 in FIG. 2. As can be seen in FIG. 3, the rearward end 44 of the support arm 32 is integrally molded with the lower deck 24, while the forward end 46 is cantilevered in order to make the forward end 46 flexible.

The assembly of the pallet 20 of the present invention will be described with respect to FIGS. 4, 4*a*, 5 and 5*a*. First, in FIGS. 4 and 4*a*, an elongated reinforcement member 56 is partially inserted between support arm 32 and guides 40 into channel 30. The reinforcement member 56 is generally elongated and is shown as a beam with a box-shaped cross-section, but may have any number of shapes, such as an I-beam. Reinforcement member 56 may be formed of metal, such as steel, a composite material, or any other type of material suitable for this application. As the reinforcement member 56 is first inserted into the channel 30, the reinforcement member 56 contacts the inclined plane 48 of the support arm 32, causing the latch 47 and the forward end 46 of the support arm 32 to deflect downward away from the channel 30. With the latch 47 of the support arm 32 out of the channel 30, the reinforcement member 56 can be slidingly inserted into the channel 30.

Figure 5:
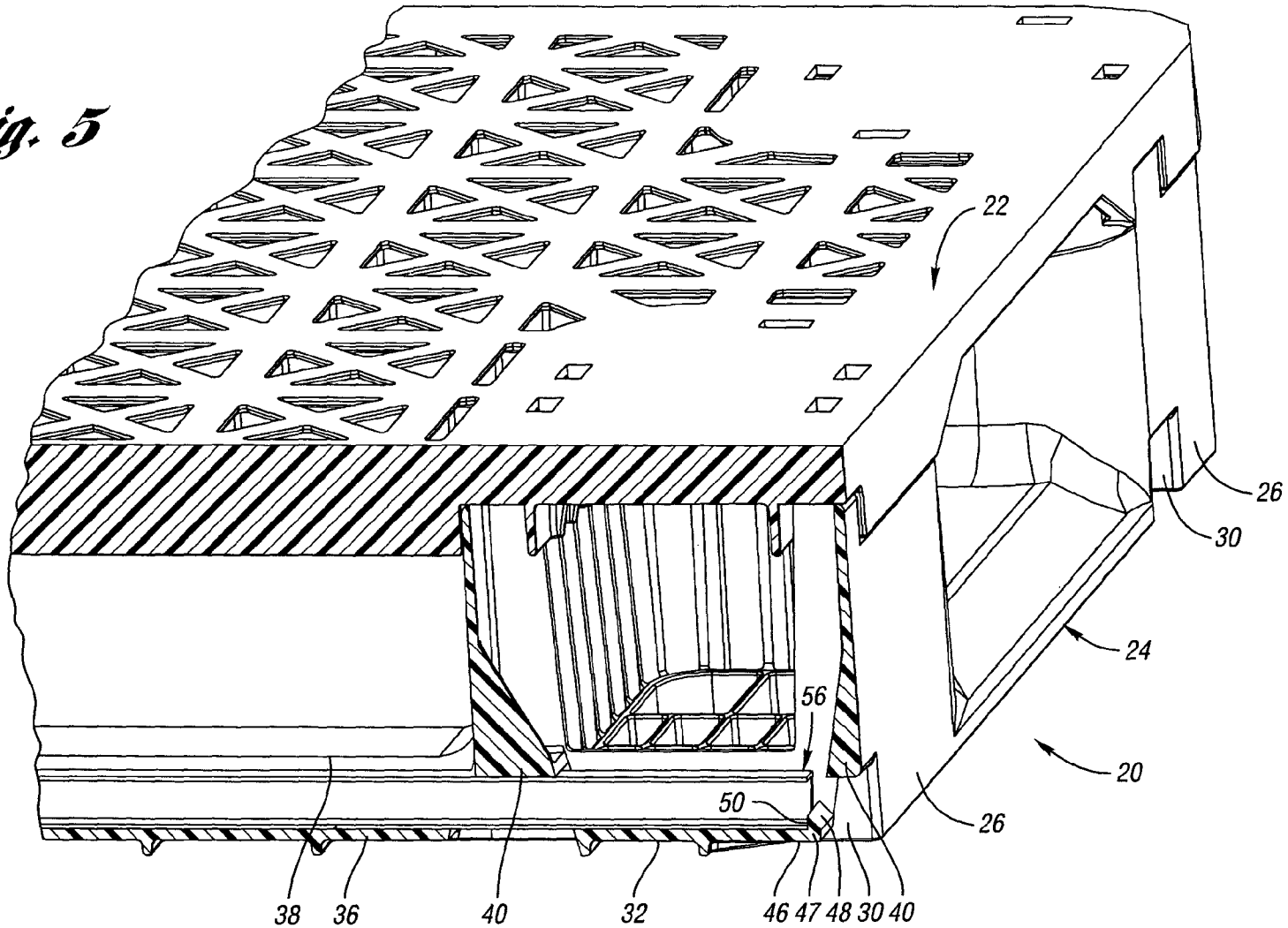
FIGS. 5 and 5*a* are similar to FIGS. 4 and 4*a* with the reinforcement member fully inserted within the channel.
Figure 5A:
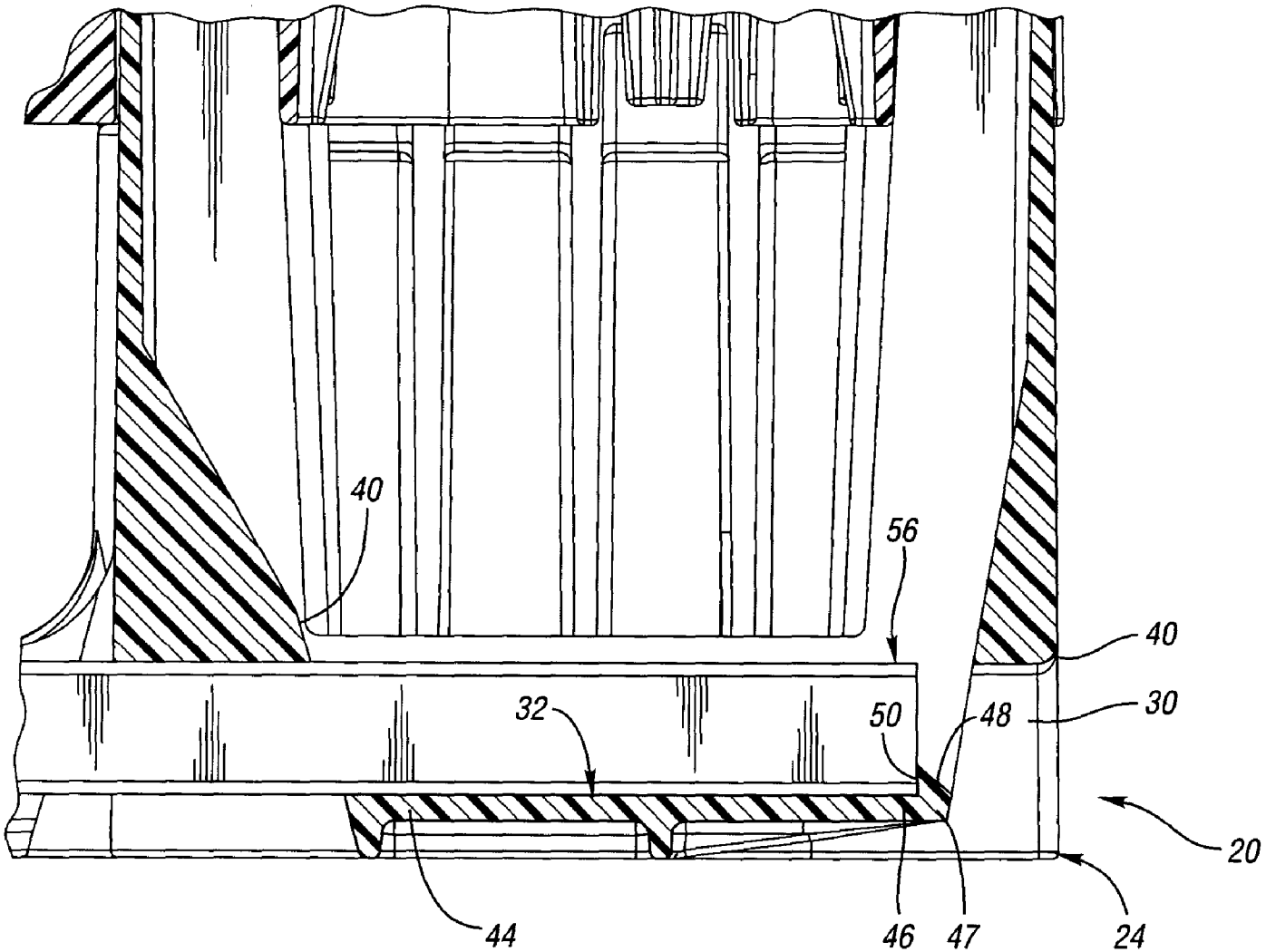

As shown in FIGS. 5 and 5*a*, when the reinforcement member 56 is inserted completely past the inclined surface 48 of the forward end 46 of the support arm 32, the latch 47 at the forward end 46 of the support arm 32 snaps back into the channel 30, thus returning to its normal, undeformed position in channel 30. In this position, the reinforcement member 56 is retained at its outer end within channel 30 by the retaining surface 50 of the latch 47 on the forward end 46 of the support arm 32. The reinforcement member 56 is thus held within the channel 30 by the support arm 32, guides 40, rail 36 and retaining surface 50. This method is then repeated for each of the channels 30, into which additional reinforcement members 56 are inserted. As shown in FIG. 6, the retaining member 56 and channel 30 is also below supports 26 to provide retention from above.

If necessary or desired, the reinforcement members 56 could be removed from the channels 30. After manually deflecting the forward end 46 of each support arm downward out of each channel 30, the reinforcement member 56 can be slid out of the channel 30.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for plastic pallets and many variations in design, many of which would benefit from the present invention. The reinforcement members 56 could be of different shapes, sizes and configurations. One or more channels 30 could be at different locations within the pallet 20, including in the lower deck 24 or the upper deck 22. All of these variations are considered to be within the scope of this invention.

What is claimed is:

1. A reinforced pallet comprising:

a plastic deck including a channel formed therein for receiving a reinforcement member; and at least one flexible support arm formed adjacent the channel, the flexible support arm extending from the deck to a free end, the flexible support arm configured to permit insertion of the reinforcement member into the channel when flexed from a locked position to an open position and configured to retain the reinforcement member within the channel when returned to the locked position.

2. The reinforced pallet of claim 1 further including a reinforcement member sized to fit within the channel.

3. The reinforced pallet of claim 1 wherein the flexible support arm is integrally molded with the deck.

4. The reinforced pallet of claim 1 wherein the support arm extends generally parallel to the channel when the support arm is in the locked position.

5. The reinforced pallet of claim 4 wherein each support arm includes a latch at a forward end and wherein the forward end flexes away from the channel upon insertion of the reinforcement member into the channel.

6. The reinforced pallet of claim 5 wherein the latch has an inclined forward surface for initially contacting the reinforcement member upon insertion of the reinforcement member into the channel, the inclined forward surface forcing the support arm away from die channel upon insertion of the reinforcement member.

7. The reinforced pallet of claim 6 wherein the support arm includes a retaining surface generally perpendicular to the channel and rearward of the inclined forward surface.

8. The reinforced pallet of claim 7 wherein the deck is a lower deck, the reinforced pallet further including an upper deck connected to the lower deck by a plurality of supports integrally molded with one of the upper deck and the lower deck.

9. The pallet of claim 1 wherein the channel is formed across substantially an entire width of the deck.

10. A reinforced pallet comprising:

a molded plastic deck including a plurality of channels molded therein and extending substantially across a width of the deck;

a plurality of flexible support arms, each integrally molded with the deck adjacent one of the plurality of channels formed in the deck, each of the flexible arms including a flexible, cantilevered forward end; and a plurality of reinforcement members, each sized to fit within one of the plurality of channels, each flexible support arm configured to permit insertion of the reinforcement member into the channel when the forward end is flexed from a locked position to an open position and configured to retain the reinforcement member within the channel when the forward end is returned to a locked position, wherein the forward end has an inclined forward surface for initially contacting the reinforcement member upon insertion into the channel, the inclined forward surface forcing the support arm away from the channel upon insertion of the reinforcement member.

11. The reinforced pallet of claim 10 wherein the support arm extends generally parallel to the channel in the locked position.

12. The reinforced pallet of claim 11 wherein the forward end is flexed away from the channel by the reinforcement member upon insertion of the reinforcement member into the channel.

13. The reinforced pallet of claim 9 wherein the support arm includes a retaining surface generally perpendicular to the channel and rearward of the inclined forward surface.

14. The reinforced pallet of claim 10 wherein the molded plastic deck is a lower deck, the pallet further including an upper deck connected to the lower deck.

15. The reinforced pallet of claim 10 wherein the plurality of channels are parallel.

16. The pallet of claim 10 wherein the support members abut the reinforcement members.

17. The pallet of claim 10 wherein the reinforcement members are made of a different material from the pallet body.

18. The pallet of claim 10 wherein the reinforcement members extend generally parallel to an upper support surface of the pallet body.

19. A reinforced pallet comprising:

a pallet body including a plurality of supports;

a plurality of support arms, each adjacent one of a plurality of channels formed in the pallet body, each support arm in a locked position adjacent the channel and being movable away from the channel to an unlocked position; and a reinforcement member within each of the plurality of channels, each support arm contacting one of the reinforcement members to retain the one reinforcement member within one of the channels when in the locked position, wherein a forward end of each of the reinforcement members has an inclined forward surface for initially contacting the reinforcement member upon insertion into the channel, the inclined forward surface forcing the support arm away from the channel upon insertion of the reinforcement member.

20. The reinforced pallet of claim 19 wherein each of the support arms is deformable away from the channel by insertion of one of the reinforcement members into the channel, thereby permitting insertion of the reinforcement member into the channel.

21. The reinforced pallet of claim 20 wherein the reinforcement member is a different material from the pallet.

22. A method for reinforcing a pallet including the steps of:

a) inserting a reinforcement member into a channel formed in a molded plastic pallet body the reinforcement member being inserted a direction generally parallel to an upper surface of the pallet body;

b) moving a latch from a locked position to an open position during said step a. the latch being mounted on a cantilevered, free end of an arm; and c) moving the latch back toward the locked position after said steps a. and b. to lock the reinforcement member in the channel.

23. The method of claim 22 wherein the latch is formed on a support arm and wherein said step b. further includes bending the support arm away from the channel.

24. The method of claim 23 wherein the support arm returns toward an undeformed state in said step c.

25. The method of claim 24 further including performing said steps a. to c. to insert each of a plurality of reinforcement members into the pallet.

26. The method of claim 22 wherein said step b) further includes the step of moving the latch in a direction generally perpendicular to the upper surface.

27. The method of claim 22 wherein the reinforcement member is inserted across substantially the entire width of the pallet body in said step a).

28. A reinforced pallet comprising:

a plastic deck including a channel formed therein; and a cantilevered flexible support arm integrally formed with the deck, the flexible support arm configured to permit insertion of a reinforcement member into the channel when flexed from a locked position to an open position and configured to retain the reinforcement member within the channel when returned to the locked position.

29. The reinforced pallet of claim 28 further including a reinforcement member received within the channel and retained in the channel by the flexible support arm.

30. A reinforced pallet comprising:

a plastic deck having a generally planar major surface, the deck having an elongated channel formed therein;

a plurality of supports extending vertically away from the deck in a direction not parallel to the major surface of the plastic deck;

a cantilevered support arm adjacent the channel, the support arm in a locked position adjacent the channel and being movable away from the channel to an unlocked position; and an elongated reinforcement member within the channel formed in the deck, the support arm retaining the reinforcement member within the channel when in the locked position, the reinforcement member extending in a direction generally parallel to the major surface of the deck, the reinforcement member extending across at least a portion of the deck that is not directly vertically aligned with one of the plurality of supports in order to reinforce the portion of the deck.

* * * * *